US008665206B2

(12) United States Patent
Lin et al.

(10) Patent No.: US 8,665,206 B2
(45) Date of Patent: Mar. 4, 2014

(54) DRIVING METHOD TO NEUTRALIZE GREY LEVEL SHIFT FOR ELECTROPHORETIC DISPLAYS

(75) Inventors: Craig Lin, San Jose, CA (US); Jiing Shiuh Chu, Kaohsiung (TW)

(73) Assignee: SiPix Imaging, Inc., Fremont, CA (US)

( * ) Notice: Subject to any disclaimer, the term of this patent is extended or adjusted under 35 U.S.C. 154(b) by 303 days.

(21) Appl. No.: 13/206,367

(22) Filed: Aug. 9, 2011
(Under 37 CFR 1.47)

(65) Prior Publication Data

US 2012/0038687 A1 Feb. 16, 2012

Related U.S. Application Data

(60) Provisional application No. 61/372,418, filed on Aug. 10, 2010.

(51) Int. Cl.
*G09G 3/34* (2006.01)

(52) U.S. Cl.
USPC ..... 345/107

(58) Field of Classification Search
USPC ..... 345/107
See application file for complete search history.

(56) References Cited

U.S. PATENT DOCUMENTS

| | | | | |
|---|---|---|---|---|
| 2008/0303780 | A1* | 12/2008 | Sprague et al. | 345/107 |
| 2008/0309953 | A1* | 12/2008 | Feng | 358/1.9 |
| 2009/0096745 | A1* | 4/2009 | Sprague et al. | 345/107 |
| 2010/0027073 | A1 | 2/2010 | Lin et al. | |
| 2010/0134538 | A1* | 6/2010 | Sprague et al. | 345/690 |
| 2011/0096104 | A1 | 4/2011 | Sprague et al. | |

OTHER PUBLICATIONS

Kao, W.C., Ye, J.A. and Lin, C. (Jan. 2009) Image Quality Improvement for Electrophoretic Displays by Combining Contrast Enhancement and Halftoning Techniques. *ICCE 2009 Digest of Technical Papers*, 11.2-2.

Kao, W.C., Ye, J.A., Chu, M.I. and Su, C.Y. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.

* cited by examiner

*Primary Examiner* — Chanh Nguyen
*Assistant Examiner* — Long D Pham
(74) *Attorney, Agent, or Firm* — Perkins Coie LLP

(57) ABSTRACT

The present invention provides driving methods for a display having a binary color system of a first color and a second color, which methods can effectively neutralize the grey level shifts due to degradation of a display medium.

12 Claims, 9 Drawing Sheets

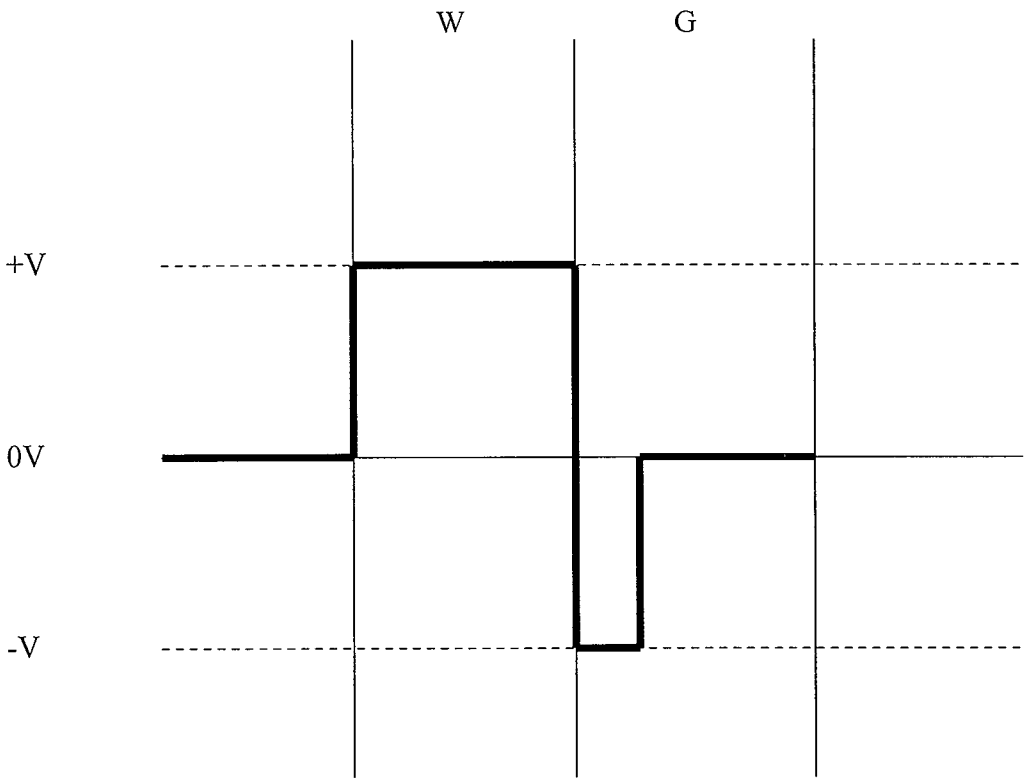
Figure 6a: WG Waveform Bipolar

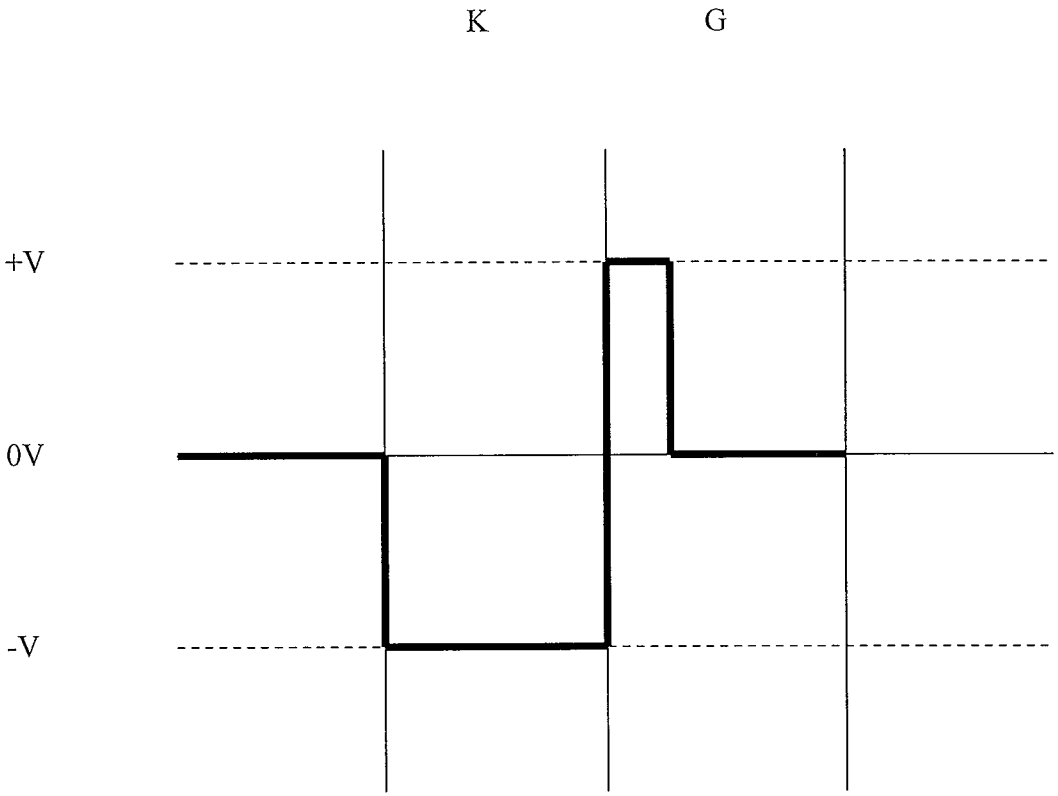
Figure 6b: KG Waveform Bipolar

DRIVING METHOD TO NEUTRALIZE GREY LEVEL SHIFT FOR ELECTROPHORETIC DISPLAYS

BENEFIT CLAIM

This application claims the benefit, under 35 U.S.C. 119 (e), of prior provisional application 61/372,418, filed Aug. 10, 2010, the entire contents of which are hereby incorporated by reference for all purposes as if fully set forth herein.

FIELD OF THE INVENTION

The present invention relates generally to electrophoretic displays.

BACKGROUND OF THE INVENTION

An electrophoretic display is a device based on the electrophoresis phenomenon of charged pigment particles dispersed in a solvent. The display usually comprises two electrode plates placed opposite of each other and a display medium comprising charged pigment particles dispersed in a solvent is sandwiched between the two electrode plates. When a voltage difference is imposed between the two electrode plates, the charged pigment particles may migrate to one side or the other, depending on the polarity of the voltage difference, to cause either the color of the pigment particles or the color of the solvent to be seen from the viewing side of the display.

Factors which may negatively affect the performance of an electrophoretic display include optical response speed decay of the display and the grey level shift under operating conditions. The decay in performance is often due to photo-exposure, temperature variation and aging of the materials used in the display device.

SUMMARY OF THE INVENTION

The present invention is directed to a driving method, which comprises:

a) selecting a first waveform or a second waveform to drive a pixel to a desired color, wherein said first waveform tends to shift the intermediate color states between the first and second colors states towards the first color after degradation, and said second waveform tends to shift the intermediate color states between the first and second color states towards the second color after degradation;

b) determining a shift error value from a grey level variation chart based on the waveform selected in (a) above and the desired color of the pixel;

c) adding the shift error value to the cumulative error value of said pixel; and d) performing error diffusion.

In one embodiment, step (a) is carried out based on the cumulative error value of the pixel. The first waveform is selected if the cumulative error value indicates a shift to the second color after degradation or the second waveform is selected if the cumulative error value indicates a shift to the first color after degradation.

In another embodiment, step (a) is carried out by:

i) determining shift error values for both a first waveform and a second waveform from a grey level variation chart based on the desired color of a pixel, wherein said first waveform tends to shift the intermediate color states between the first and second colors states towards the first color after degradation, and said second waveform tends to shift the intermediate color states between the first and second color states towards the second color after degradation;

ii) adding each of the shift error values to the cumulative error value of the pixel; and iii) selecting the first waveform or the second waveform whose sum of the shift error value and the cumulative error value has a smaller absolute value.

Step (d) of the driving method comprises:

i) diffusing the sum of the shift error value and the cumulative error value of the pixel, to the neighboring pixels; and ii) adding the error value diffused to the cumulative error value resulted from processing of previous pixels, for each neighboring pixel.

The cumulative error values for a pixel in the display device are generated in a waveform map.

The driving methods of the present invention can effectively neutralize the grey level shifts due to degradation of a display medium.

BRIEF DISCUSSION OF THE DRAWINGS

FIG. 1 illustrates an electrophoretic display.

FIGS. 2*a*-2*c* show an example of a binary color system.

FIGS. 6*a* and 6*b* show examples of bi-polar waveforms suitable for the driving methods of the present invention.

Figure 7:
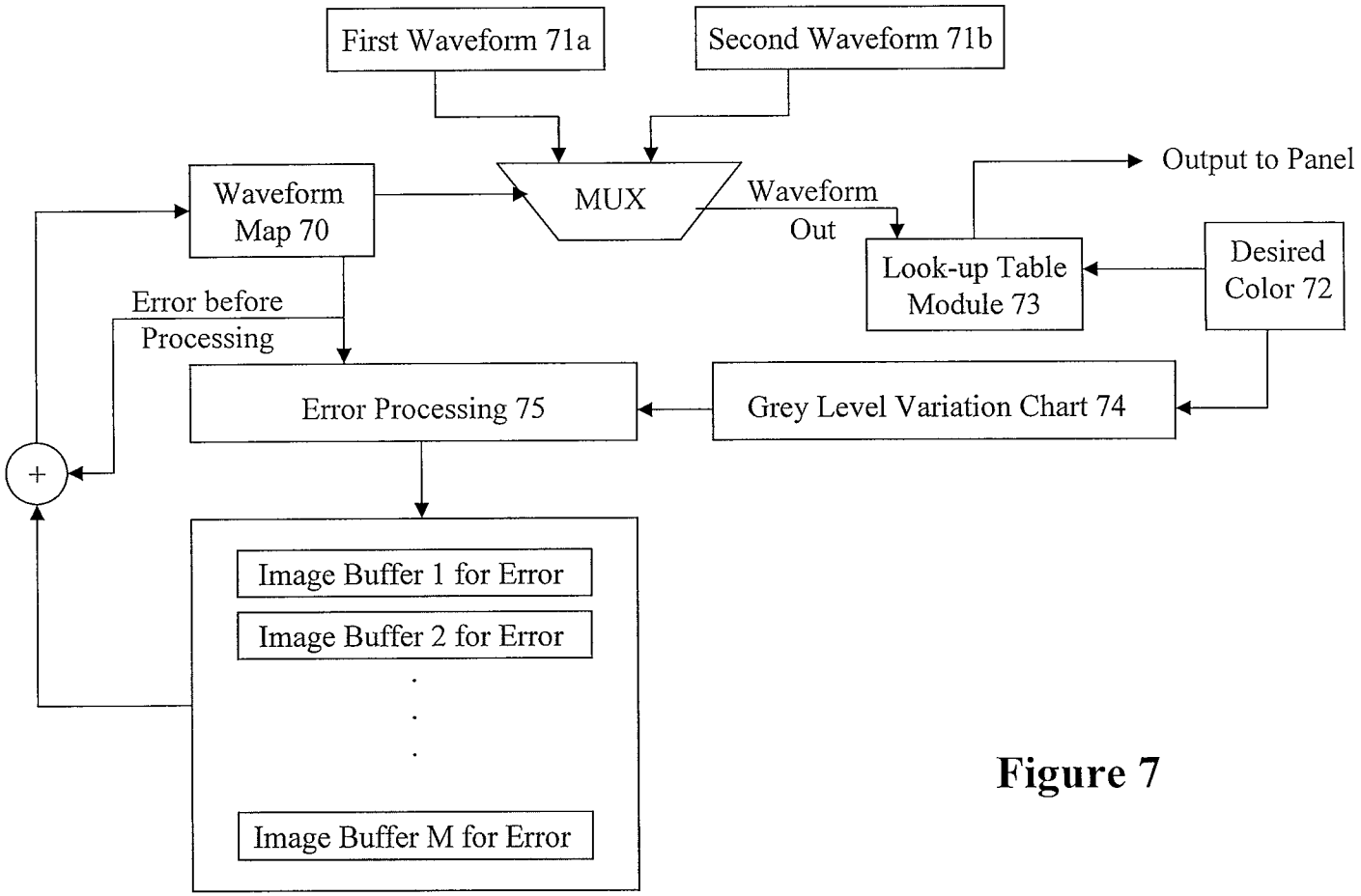

FIG. 7 is a block diagram of hardware for Example 3.

Figure 8:
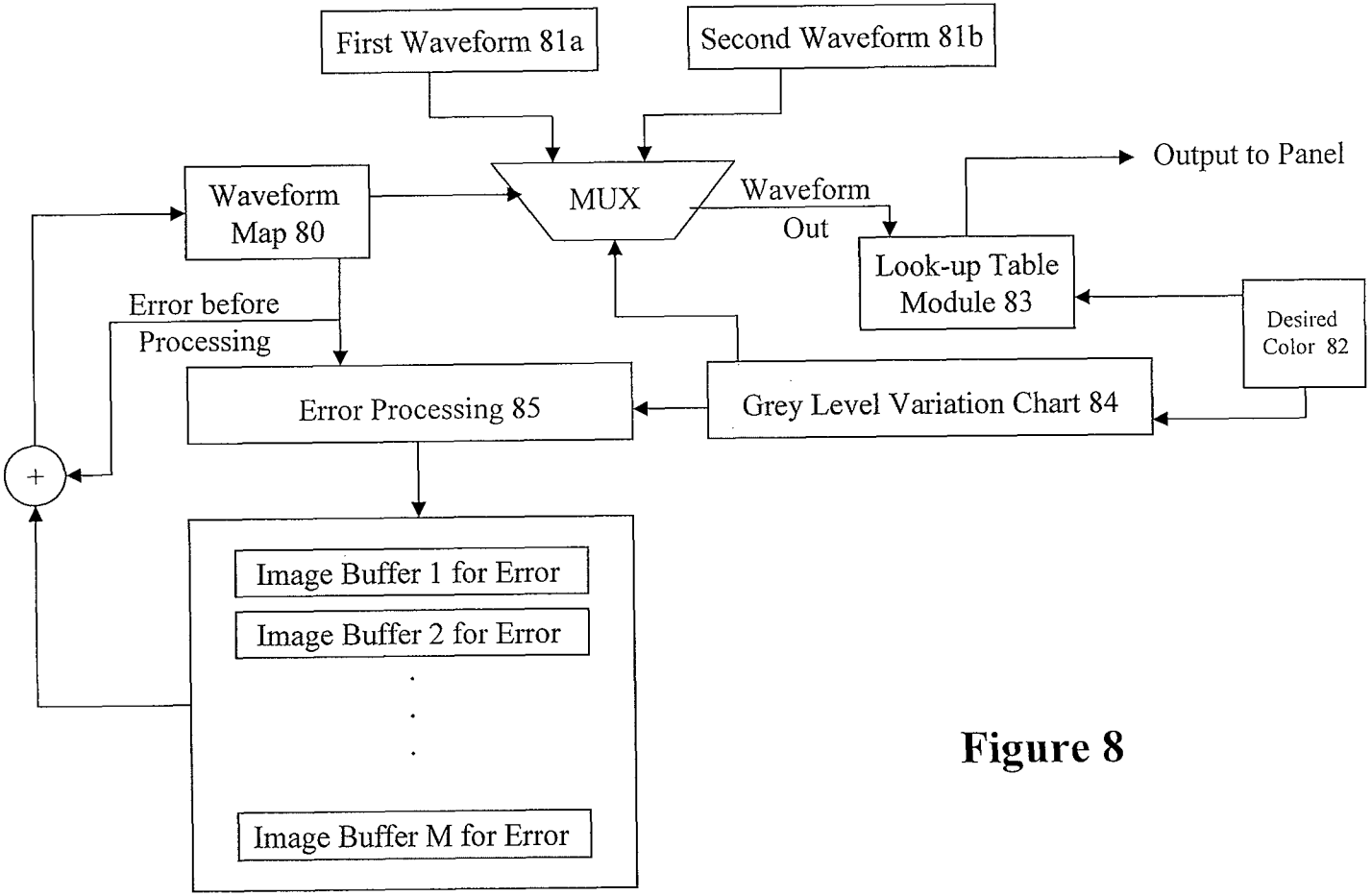

FIG. 8 is a block diagram of hardware for Example 4.

DETAILED DESCRIPTION OF THE INVENTION

Figure 1:
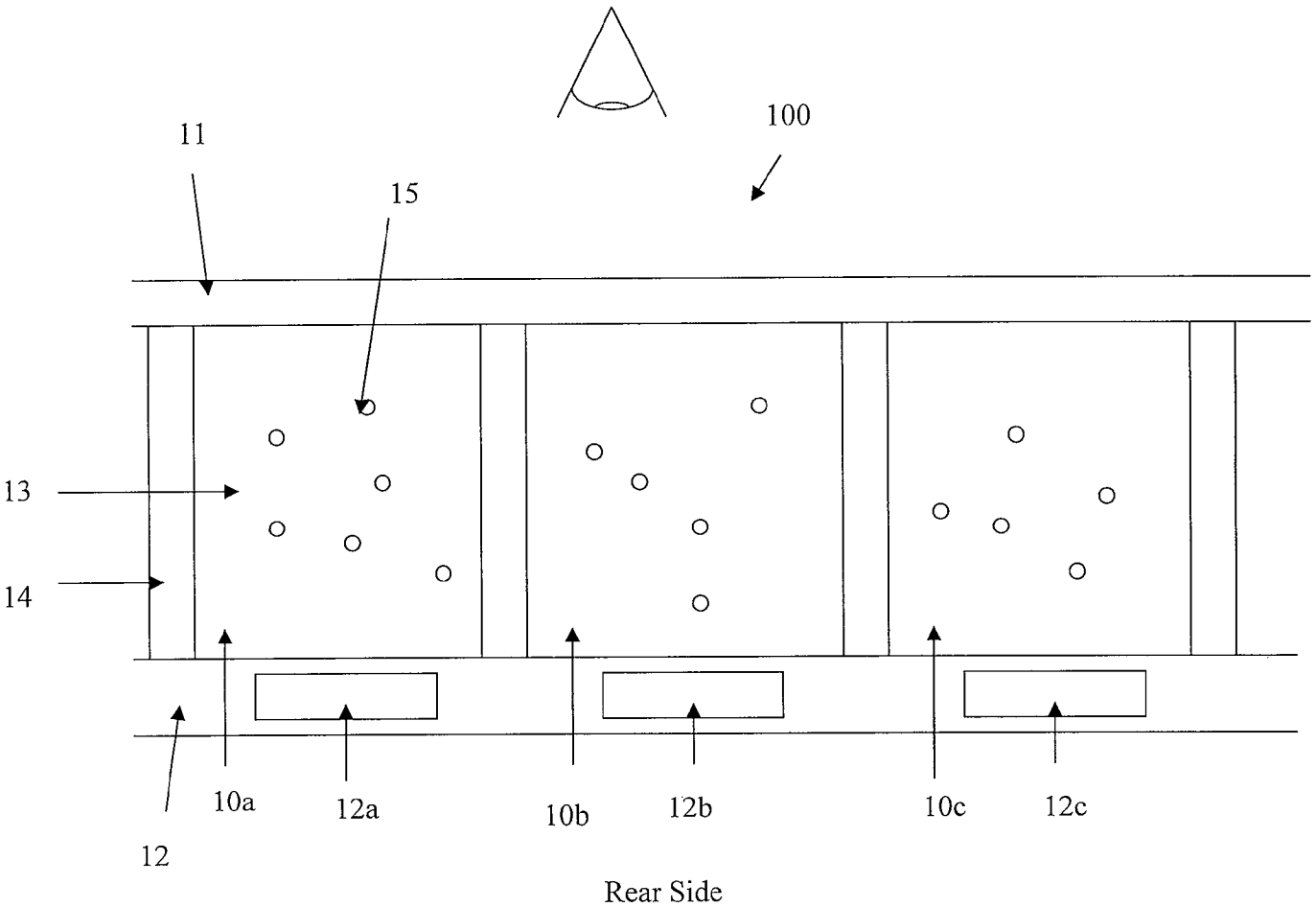

FIG. 1 illustrates an electrophoretic display (100) which may be driven by the driving methods presented herein. In FIG. 1, the electrophoretic display cells 10*a*, 10*b*, 10*c*, on the front viewing side indicated with a graphic eye, are provided with a common electrode 11 (which is usually transparent and therefore on the viewing side). On the opposing side (i.e., the rear side) of the electrophoretic display cells 10*a*, 10*b* and 10*c*, a substrate (12) includes discrete pixel electrodes 12*a*, 12*b* and 12*c*, respectively. Each of the pixel electrodes 12*a*, 12*b* and 12*c* defines an individual pixel of the electrophoretic display. However, in practice, a plurality of display cells (as a pixel) may be associated with one discrete pixel electrode.

It is also noted that the display device may be viewed from the rear side when the substrate 12 and the pixel electrodes are transparent.

An electrophoretic fluid 13 is filled in each of the electrophoretic display cells. Each of the electrophoretic display cells is surrounded by display cell walls 14.

The movement of the charged particles in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode in a display cell, the positively charged pigment particles will then be drawn to the electrode which has a lower voltage potential.

In another embodiment, the charged pigment particles 15 may be negatively charged.

In a further embodiment, the electrophoretic display fluid could also have a transparent or lightly colored solvent or solvent mixture and charged particles of two different colors carrying opposite particle charges, and/or having differing electro-kinetic properties. For example, there may be white pigment particles which are positively charged and black pigment particles which are negatively charged and the two types of pigment particles are dispersed in a clear solvent or solvent mixture.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

The term "display cell" is intended to refer to a microcontainer which is individually filled with a display fluid. Examples of "display cell" include, but are not limited to, microcups, microcapsules, micro-channels, other partition-typed display cells and equivalents thereof. In the microcup type, the electrophoretic display cells 10*a*, 10*b*, 10*c* may be sealed with a top sealing layer. There may also be an adhesive layer between the electrophoretic display cells 10*a*, 10*b*, 10*c* and the common electrode 11.

In this application, the term "driving voltage" is used to refer to the voltage potential difference experienced by the charged particles in the area of a pixel. The driving voltage is the potential difference between the voltage applied to the common electrode and the voltage applied to the pixel electrode. As an example, in a binary system, positively charged white particles are dispersed in a black solvent. When no voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when no voltage is applied to a common electrode and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

The term "binary color system" refers to a color system has two extreme color states (i.e., the first color and the second color) and a series of intermediate color states between the two extreme color states.

Figure 2:
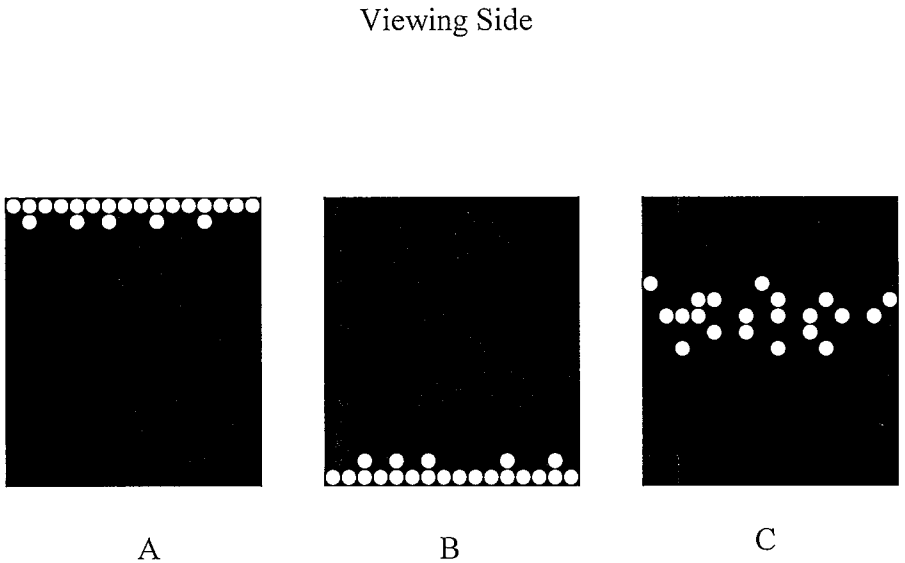

FIG. 2 is an example of a binary color system in which white particles are dispersed in a black-colored solvent.

In FIG. 2A, while the white particles are at the viewing side, the white color is seen.

In FIG. 2B, while the white particles are at the bottom of the display cell, the black color is seen.

In FIG. 2C, the white particles are scattered between the top and bottom of the display cell; an intermediate color is seen. In practice, the particles may spread throughout the depth of the cell or are distributed with some at the top and some at the bottom. In this example, the color seen would be grey (i.e., an intermediate color).

While black and white colors are used in the application for illustration purpose, it is noted that the two colors can be any colors as long as they show sufficient visual contrast. Therefore the two colors in a binary color system may also be referred to as a first color and a second color.

The intermediate color is a color between the first and second colors. The intermediate color has different degrees of intensity, on a scale between two extremes, i.e., the first and second colors. Using the grey color as an example, it may have a grey scale of 8, 16, 64, 256 or more. In a grey scale of 8, grey level 0 may be the full black color and grey level 7 may be the full white color. Grey levels 1-6 are grey colors ranging from dark to light.

The present inventors have now found driving methods for a display having a binary color system of a first color and a second color, which methods can effectively neutralize the grey level shifts due to degradation of a display medium.

Before discussing the specifics of the driving methods, the error diffusion technique which is an essential feature of the methods is briefly described in the following.

Error diffusion is generally known to be a type of halftoning or spatial dithering in which the residual error is distributed to neighboring pixels which have not yet been processed. The error diffusion process may be a one dimensional or two dimensional error diffusion process. The one dimensional error diffusion technique is the simplest form of the algorithm and scans the image one row at a time and one pixel at a time. The error is then added to the value of the next pixel in the image and the process repeats. The algorithm of the two dimensional error diffusion is exactly like one dimensional error diffusion, except, for example, half the error is added to the next pixel and one quarter of the error is added to the pixel on the next line below and one quarter of the error is added to the pixel on the next line below and one pixel forward.

Floyd-Steinberg dithering is another error diffusion technique commonly used by image manipulation processor. The algorithm achieves dithering by diffusing the residual error of a pixel to its neighboring pixels, according to the distribution:

$$\frac{1}{16}\begin{bmatrix} - & \# & 7 \\ 3 & 5 & 1 \end{bmatrix}$$

where "—" denotes a pixel in the current row which has already been processed (hence diffusing an error to it is not possible), and "#" denotes the pixel currently being processed.

The algorithm scans the image from left to right, top to bottom, processing pixel values one by one. Each time the residual error is transferred to the neighboring pixels, while not affecting the pixels that already have been processed. Hence, if a number of pixels have been rounded downwards, it becomes more likely that the next pixel is rounded upwards, such that on average, the error is normalized to be close to zero.

Another method is referred to as "minimized average error," and uses a larger kernel:

$$\frac{1}{48}\begin{bmatrix} - & - & \# & 7 & 5 \\ 3 & 5 & 7 & 5 & 3 \\ 1 & 3 & 5 & 3 & 1 \end{bmatrix}$$

The present invention is directed to a driving method for a display having a binary color system of a first color and a second color, which comprises:

a) selecting a first waveform or a second waveform to drive a pixel to a desired color, wherein said first waveform tends to shift the intermediate color states between the first and second colors states towards the first color after degradation, and said second waveform tends to shift the intermediate color states between the first and second color states towards the second color after degradation;

b) determining a shift error value from a grey level variation chart based on the waveform selected in (a) above and the desired color of the pixel;

c) adding the shift error value to the cumulative error value of the pixel; and d) performing error diffusion.

In a first aspect of the present invention, the selection step (a) is carried out based on the cumulative error value for the pixel, resulted from processing of previous pixels. In addition, if the cumulative error value indicates a shift to the second color after degradation, the first waveform would be selected, and if the cumulative error value indicates a shift to the first color after degradation, the second waveform would be selected.

In the method described above, the term "a desired color" is intended to refer to the first color, the second color or an intermediate color of any level.

One pixel at a time is processed for error diffusion. Therefore the term "cumulative" error for a pixel is intended to refer to the error value accumulated from processing of previous pixels.

The shift error value in step (b) is determined from a grey level variation chart. The shift error value is the difference between the intended grey level and the actual grey level displayed. The grey level variation chart is unique to each display device because the chart may vary from one display device to another display device, depending on the medium property of each display device. In the grey level variation chart, the variation for each grey level expressed in a grey scale of a higher order is preferred. For example, while a display device may display images in a grey scale of 16 levels (e.g., 0-15), in the operation of error diffusion, the variation of each grey level is preferably expanded to a grey scale of 256. This step is necessary for the sake of precision, because the variation for each grey level may only be expressed in the form of an integer. A specific example of a grey level variation chart is given below.

The error diffusion step (d) may comprise:

i) diffusing the sum of the shift error value and the cumulative error value of the pixel, to the neighboring pixels; and ii) adding the error value diffused to the cumulative error value resulted from processing of previous pixels, for each neighboring pixel.

In performing the error diffusion, in the context of the present invention, a waveform map is used, in which the cumulative error value due to grey level shift for each pixel is indicated. Based on the cumulative error value, an appropriate waveform is selected for each pixel, as discussed above for step (a) of the method.

The second aspect of the present invention is directed to an alternative driving method. In this aspect, the selection of the waveform is carried out in a different manner, which comprises the following steps:

i) determining shift error values for both a first waveform and a second waveform from a grey level variation chart based on the desired color of a pixel, wherein said first waveform tends to shift the intermediate color states between the first and second colors states towards the first color after degradation, and said second waveform tends to shift the intermediate color states between the first and second color states towards the second color after degradation;

ii) adding each of the shift error values to the cumulative error value of the pixel; and then iii) selecting the first waveform or the second waveform whose sum of the shift error value and the cumulative error value has a smaller absolute value.

The error diffusion step of this alternative method is the same as that for the first aspect of the invention, which may comprise:

i) diffusing the sum of the shift error value and the cumulative error value of the pixel, to neighboring pixels; and ii) adding the error diffused to the cumulative error value resulted from processing of previous pixels, for each neighboring pixel.

The present driving methods are suitable for not only display devices with a degraded medium but also for those with a fresh medium. When the methods are carried out on a display device with a fresh medium, the exact steps of error diffusion as described herein will be followed. As a result, the display driving system does not need to know the state of the medium degradation when carrying out the present methods and good image quality can be achieved in both cases.

More details are demonstrated in the following examples.

EXAMPLES

Example 1

Mono-Polar Waveforms

Figure 3:
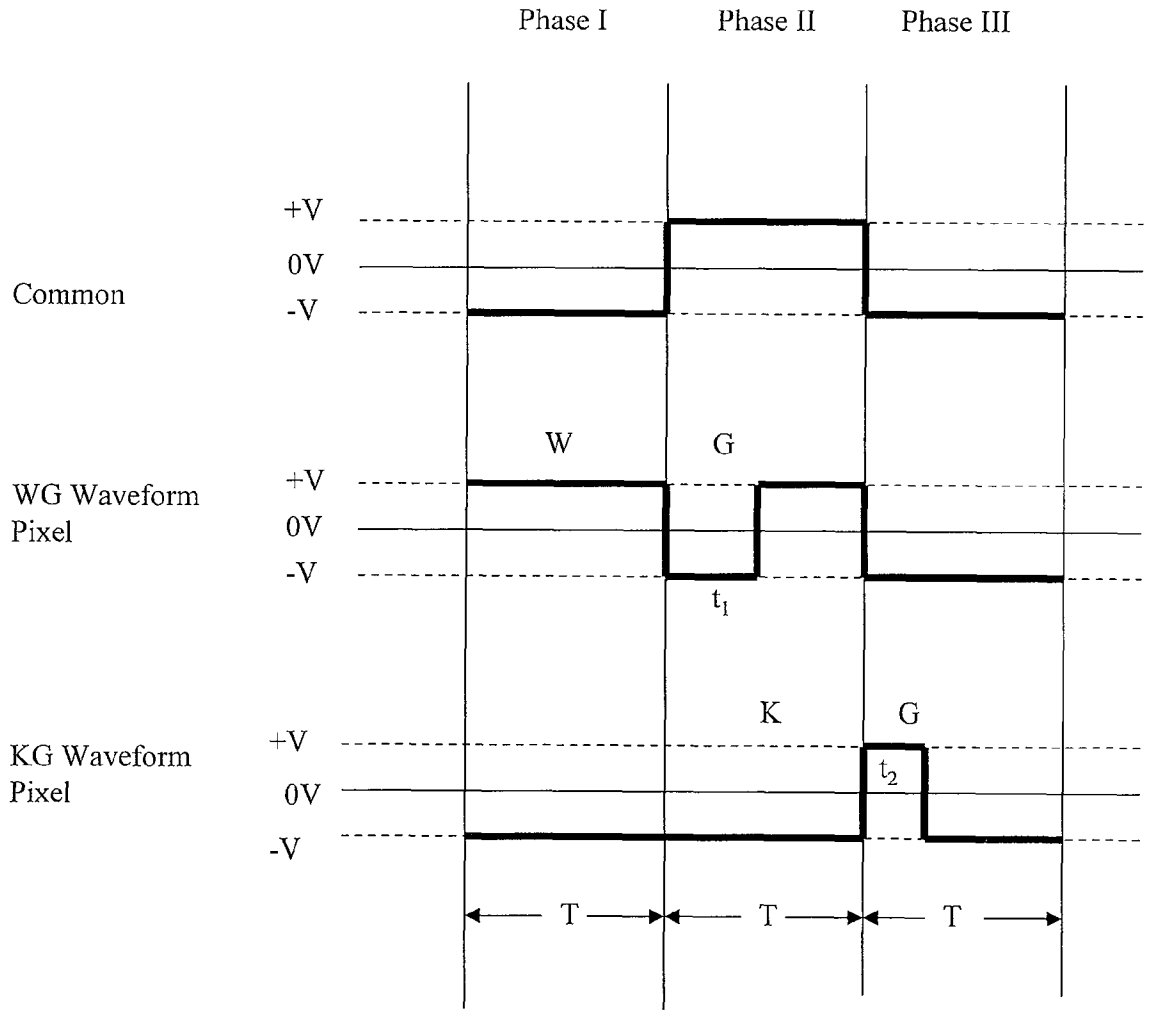
FIG. 3 shows an example of mono-polar waveforms suitable for the driving methods of the present invention.

FIG. 3 shows an example of the first and second waveforms referred to in the methods as described. As shown, the two waveforms marked as "WG" and "KG" waveforms have three driving phases (I, II and III). Each driving phase has a driving time of equal length, T, which is sufficiently long to drive a pixel to a full white or a full black state, regardless of the previous color state.

For illustration purpose, FIG. 3 represents an electrophoretic fluid comprising positively charged white pigment particles dispersed in a black solvent.

The common electrode is applied a voltage of −V, +V and −V during Phase I, II and III, respectively.

For the WG waveform, during Phase I, the common electrode is applied a voltage of −V and the pixel electrode is applied a voltage of +V, resulting a driving voltage of +2V and as a result, the positively charged white pigment particles move to be near or at the common electrode, causing the pixel to be seen in a white color. During Phase II, a voltage of +V is applied to the common electrode and a voltage of −V is applied to the pixel electrode for a driving time duration of t1. If the time duration t1 is 0, the pixel would remain in the white state. If the time duration t1 is T, the pixel would be driven to the full black state. If the time duration t1 is between 0 and T, the pixel would be in a grey state and the longer t1 is, the darker the grey color. After t1 in Phase II and also in Phase III, the driving voltage for the pixel is shown to be 0V and as a result, the color of the pixel would remain in the same color state as that at the end of t1 (i.e., white, black or grey). Therefore, the WG waveform is capable of driving a pixel to a full white (W) color state (in Phase I) and then to a black (K), white (W) or grey (G) state (in Phase II).

For the KG waveform, in Phase I, both the common and pixel electrodes are applied a voltage of −V, resulting in 0V driving voltage and as a result, the pixel remains in its initial color state. During Phase II, the common electrode is applied a voltage of +V while the pixel electrode is applied a voltage of −V, resulting in a −2V driving voltage, which drives the pixel to the black state. In Phase III, the common electrode is applied a voltage of −V and the pixel electrode is applied a voltage of +V for a driving time duration of t2. If the time duration t2 is 0, the pixel would remain in the black state. If the time duration t2 is T, the pixel would be driven to the full white state. If the time duration t2 is between 0 and T, the pixel would be in a grey state and the longer t1 is, the lighter the grey color. After t2 in Phase III, the driving voltage is 0V, thus allowing the pixel to remain in the same color state as that at the end of t2. Therefore, the KG waveform is capable of driving a pixel to a full black (K) state (in Phase II) and then to a black (K), white (W) or grey (G) state (in Phase III).

The term "full white" or "full black" state is intended to refer to a state where the white or black color has the highest intensity possible of that color for a particular display device. Likewise, a "full first color" or a "full second color" refers to a first or second color state at its highest color intensity possible.

Either one of the two waveforms (WG and KG) can be used to generate a grey level image as long as the lengths of the grey pulses are correctly chosen for the grey levels to be generated.

It is noted that varying durations of t1 or t2 in the WG and KG waveforms provide different levels of the grey color. However, in practice, t1 or t2 is fixed in the WG and KG waveforms to achieve a particular grey level. But as the response speed becomes slower due to environmental conditions or aging of the display device, the fixed t1 or t2 in the waveforms would drive the display device to a grey level which is not the same as the originally intended grey level.

Figure 4:
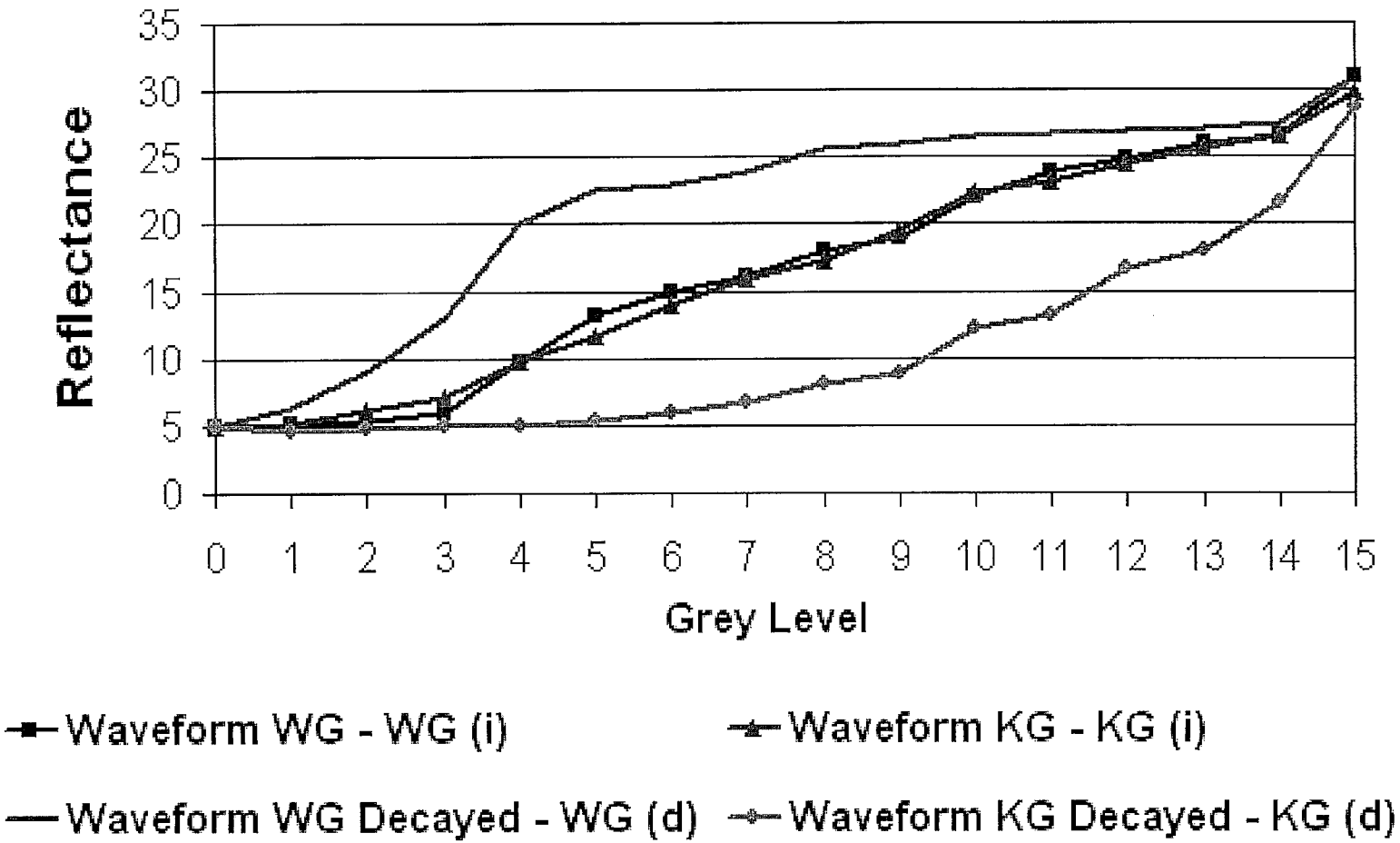
FIG. 4 is a graph which shows how the response speed degrades after time.

FIG. 4 is a graph which shows how the response speed degrades after time. In the figure, for the WG waveform, line WG(i) is the initial curve of reflectance at different grey levels (0-15), and line WG(d) is the curve of reflectance at different grey levels (0-15) after degradation of the display medium. For the KG waveform, line KG(i) is the initial curve of reflectance at grey different levels (0-15) and line KG(d) is the curve after degradation.

As shown, the grey levels show a higher reflectance when driven by the WG waveform due to medium degradation. In other words, the grey levels achieved by the WG waveform tend to shift towards the white color state. As a result, the colors of the images driven by the degraded WG waveform would appear washed out.

On the other hand, the grey levels show a lower reflectance when driven by the KG waveform due to medium degradation. In other words, the grey levels achieved by the KG waveform tend to shift towards the black color state. As a result, the colors of the images driven by the degraded KG waveform would appear darker.

In addition, as shown in FIG. 4, the degree of shift between WG(i) and WG(d) is not the same as the degree of shift between KG(i) and KG(d). For example, the reflectance of grey level 4 has shifted from 9.6% to 19.6% with the WG waveform and the reflectance of grey level 4 has shifted from 9.8% to 4.9%, with the KG waveform. In other words, the WG waveform has shifted +10% (becoming lighter) in reflectance while the KG waveform has shifted −4.9% (becoming darker) in reflectance.

When waveforms WG and KG are used, one of the methods of the present invention may be summarized as follows:

a) selecting the WG or KG waveform to drive a pixel to a desired color, based on a cumulative error value resulted from processing of previous pixels, wherein the WG waveform tends to shift the grey level color states between the black and white colors states towards the white color after degradation, and the KG waveform tends to shift the grey level color states between the black and white color states towards the black color after degradation;

b) determining a shift error value from a grey level variation chart based on the waveform selected in (a) above and the desired color of the pixel;

c) adding the shift error value to the cumulative error value of the pixel; and d) performing error diffusion.

The alternative driving method may be summarized as follows:

a) determining shift error values for both the WG and KG waveforms from a grey level variation chart based on the desired color of a pixel, wherein the WG waveform tends to shift the grey level color states between the black and white colors states towards the white color after degradation, and the KG waveform tends to shift the grey level color states between the black and white color states towards the black color after degradation;

b) adding each of the shift error values to the cumulative error value of the pixel;

c) selecting the WG waveform or the KG waveform whose sum of the shift error value and the cumulative error value has a smaller absolute value;

d) determining a shift error value from a grey level variation chart based on the waveform selected in (c) above and the desired color of the pixel;

e) adding the shift error value to the cumulative error value of the pixel; and f) performing error diffusion.

Example 2

A Grey Level Variation Chart

| Intended | WG Waveform | | KG Waveform | |
|---|---|---|---|---|
| Grey Level | Initial Actual | Degraded Actual | Initial Actual | Degraded Actual |
| 0 | 0 | 0 | 0 | 0 |
| 1 | 40 | 82 | 41 | 0 |
| 2 | 51 | 109 | 63 | 20 |
| 3 | 69 | 150 | 87 | 26 |
| 4 | 118 | 197 | 120 | 25 |
| 5 | 145 | 210 | 134 | 42 |
| 6 | 166 | 218 | 158 | 58 |
| 7 | 174 | 220 | 171 | 72 |
| 8 | 187 | 230 | 182 | 101 |
| 9 | 194 | 232 | 197 | 112 |
| 10 | 208 | 234 | 210 | 140 |
| 11 | 220 | 236 | 215 | 151 |
| 12 | 225 | 236 | 224 | 177 |
| 13 | 232 | 238 | 229 | 188 |
| 14 | 235 | 238 | 235 | 207 |
| 15 | 255 | 255 | 255 | 255 |

In this example, grey level 0 indicates a full black state and grey level 15 indicates a full white state. When expressed in a grey scale of 256 levels, similarly, level 0 indicates a full black state and level 255 indicates a full white state.

The chart also shows that there may be a slight variation in the initial state between the WG and the KG waveforms, when expanded to a higher order. For example, for the intended grey level 5, the WG waveform shows an initial state of 145 while the KG waveform shows an initial state of 134, expressed in a grey scale of 256. This is due to driving limitation of the platform (e.g., frame time); but this can be improved if the system is operated in a higher frequency.

The chart also shows how speed decay affects the grey levels. For the WG waveform, the grey level variation tends to trend higher (a positive variation) which indicates that the grey levels displayed after degradation are brighter than originally intended. For the KG waveform, the grey level variation tends to trend lower (a negative variation) which means that the grey levels displayed after degradation are darker than originally intended. This phenomenon in fact is essential for selecting an appropriate waveform (WG or KG) for a particular pixel in order to neutralize the reflectance increase or decrease due to speed decay.

Example 3

Error Diffusion and Waveform Map

In this example, a display image of 12 pixels (A-L) is used to illustrate error diffusion.

| | | | | | |
|---|---|---|---|---|---|
| A | B | C | D | E | F |
| G | H | I | J | K | L |

The target image in this example is:

| | | | | | |
|---|---|---|---|---|---|
| A(10) | B(5) | C(4) | D(7) | E(5) | F(4) |
| G(8) | H(7) | I(5) | J(4) | K(5) | L(5) |

This means that in the target image, the 12 pixels A-L are driven to grey levels 10, 5, 4, 7, 5, 4, 8, 7, 5, 4, 5 and 5 respectively.

The following is a sequence of waveform maps showing how the method is carried out:

Starting Waveform Map:

| | | | | | |
|---|---|---|---|---|---|
| A(0) | B(0) | C(0) | D(0) | E(0) | F(0) |
| G(0) | H(0) | I(0) | J(0) | K(0) | L(0) |

Waveform Map after Pixel A is processed:

| | | | | | |
|---|---|---|---|---|---|
| A(WG) | B(+11) | C(0) | D(0) | E(0) | F(0) |
| G(+8) | H(+2) | I(0) | J(0) | K(0) | L(0) |

Waveform Map after Pixel B is processed:

| | | | | | |
|---|---|---|---|---|---|
| A(WG) | B(KG) | C(−35) | D(0) | E(0) | F(0) |
| G(−7) | H(−23) | I(−5) | J(0) | K(0) | L(0) |

Waveform Map after Pixel C is processed:

| | | | | | |
|---|---|---|---|---|---|
| A(WG) | B(KG) | C(WG) | D(+19) | E(0) | F(0) |
| G(−7) | H(−15) | I(+9) | J(+3) | K(0) | L(0) |

The Starting Waveform Map is the initial state of the waveform map in which each pixel shows a cumulative error of 0.

As the error diffusion progresses in the waveform map from left to right and top to bottom, the process is performed from pixel A to pixel L, one pixel at a time.

For pixel A, since the cumulative error is 0, either waveform WG or waveform KG may be chosen. If waveform WG is selected, the shift error value based on the grey level variation chart in Example 2 would be +26 (234−208) for grey level 10 (which is the target grey level for pixel A).

Then based on the Floyd-Steinberg algorithm, this error of +26 is diffused to the neighboring pixels: +11 (+26×7/16) to pixel B, +8 (+26×5/16) to pixel G and +2 (+26×1/16) to pixel H, as shown in the Waveform Map, after Pixel A is processed.

For pixel B, it has already shown a positive cumulative error of +11 in Waveform Map after Pixel A is processed. As indicated above, a positive cumulative error value is indicative of a pixel the grey level of which tends to shift to a lighter color. Therefore waveform KG is selected to neutralize the shift.

The target grey level of pixel B is 5. According to the grey level variation chart for waveform KG in Example 2, a shift error value of −92 (42−134) would occur for grey level 5. This shift error value of −92 is then mathematically added to the existing cumulative error value (from processing of previous pixels) of +11 for pixel B, resulting in a cumulative error value of −81. The cumulative error of −81 is then diffused to the neighboring pixels (C, G, H & I) based on the Floyd-Steinberg algorithm. The result is shown in the Waveform Map, after Pixel B is processed.

It is noted that the error value diffused from pixel B must be mathematically added to the existing cumulative error value resulted from processing of previous pixels. For example, pixel G already has a cumulative error value at this stage of +8 and now an error value of −15 (−81×3/16) is diffused to this pixel, resulting in a cumulative error of −7 in the Waveform Map, after Pixel B is processed.

For pixel C, it has already shown a negative cumulative error of −35. Therefore waveform WG is selected to neutralize the shift to a darker color.

The target grey level of pixel C is 4. According to the grey level variation chart for waveform WG in Example 2, a shift error value of +79 (197−118) would occur for grey level 4. This shift error value of +79 is then mathematically added to the existing cumulative error value of −35 for pixel C, resulting in a cumulative error value of +44. The cumulative error of +44 is then diffused to the neighboring pixels (D, H, I & J) based on the Floyd-Steinberg algorithm. The result is shown in the Waveform Map, after Pixel C is processed.

This process continues (from left to right and top to bottom) until the waveform map is complete to show which pixel is driven by which waveform.

Final Waveform Map:

| | | | | | |
|---|---|---|---|---|---|
| A(WG) | B(KG) | C(WG) | D(KG) | E(WG) | F(KG) |
| G(WG) | H(KG) | I(WG) | J(WG) | K(KG) | L(WG) |

The method as demonstrated may reduce the errors (caused by speed degradation) to substantially zero.

It is noted that while the Floyd-Steinberg algorithm is used in this example, other error diffusion algorithms may be similarly applied.

Example 4

Block Diagram of Hardware for Example 3

A block diagram in FIG. 7 illustrates the method demonstrated in Example 3. As shown, based on the cumulative error value for a pixel in waveform map (70), a waveform (either the first waveform 71*a* or the second waveform 71*b*) is selected. Both the selected waveform and the desired color (72) of the pixel then are input into the look-up table module (73). The data thus generated from the look-up table module are output to the display panel.

In the meantime, the sum of the shift error value from a grey level variation chart (74) based on the selected waveform and desired color (72), and the cumulative error for the pixel in the waveform map (70) undergoes the process of error diffusion (75). The error value diffused to each of the neighboring pixels is then mathematically added to the cumulative error value for that neighboring pixel, resulting in an updated waveform map. The process as described continues.

Example 5

Alternative Driving Method

In this example demonstrating an alternative driving method, the display image of 12 pixels (A-L) as shown in Example 3 and the same target image are used for illustration purpose:

| | | | | | |
|---|---|---|---|---|---|
| A | B | C | D | E | F |
| G | H | I | J | K | L |
| A(10) | B(5) | C(4) | D(7) | E(5) | F(4) |
| G(8) | H(7) | I(5) | J(4) | K(5) | L(5) |

The following is a sequence of waveform maps showing how this alternative method is carried out:

Starting Waveform Map:

| | | | | | |
|---|---|---|---|---|---|
| A(0) | B(0) | C(0) | D(0) | E(0) | F(0) |
| G(0) | H(0) | I(0) | J(0) | K(0) | L(0) |

Waveform Map after Pixel A is processed:

| | | | | | |
|---|---|---|---|---|---|
| A(WG) | B(+11) | C(0) | D(0) | E(0) | F(0) |
| G(+8) | H(+2) | I(0) | J(0) | K(0) | L(0) |

Waveform Map after Pixel B is processed:

| | | | | | |
|---|---|---|---|---|---|
| A(WG) | B(WG) | C(+33) | D(0) | E(0) | F(0) |
| G(+22) | H(+26) | I(+5) | J(0) | K(0) | L(0) |

Waveform Map after Pixel C is processed:

| | | | | | |
|---|---|---|---|---|---|
| A(WG) | B(WG) | C(KG) | D(−27) | E(0) | F(0) |
| G(+22) | H(+14) | I(−14) | J(−4) | K(0) | L(0) |

The Starting Waveform Map is the initial state of the waveform map in which each pixel shows a cumulative error value of 0.

The error diffusion also progresses in the waveform map from left to right and top to bottom, the process is performed from pixel A to pixel L, one pixel at a time.

For pixel A, since the initial cumulative error value is 0, either waveform WG or waveform KG may be chosen. If waveform WG is selected, the shift error based on the grey level variation chart in Example 2 would be +26 (234−208) for grey level 10 (which is the target grey level for pixel A).

Then based on the Floyd-Steinberg algorithm, this shift error value of +26 is diffused to the neighboring pixels: +11 (+26×7/16) to pixel B, +8 (+26×5/16) to pixel G and +2 (+26×1/16) to pixel H, as shown in the Waveform Map, after Pixel A is processed.

The processing of pixel B, however, is different from that shown in Example 3. In this case, both the WG and KG waveforms are considered. For the WG waveform to drive pixel B to the target grey level 5, the shift error would be +65 (210−145) and for the KG waveform to drive pixel B to the target grey level 5, the shift error would be −92 (42−134), based on the grey level variation chart in Example 2. Each of the shift errors is then added to the existing cumulative error value of +11 from processing of previous pixel(s) (i.e., pixel A in this case). The sums of "the shift error value and the cumulative error value" are then +76 (+65+11) and −81 (−92+11) for the WG and KG waveforms respectively. According to the alternative method, waveform WG would be selected because its sum of "the shift error value and the existing cumulative error value" has a smaller absolute value (76 vs. 81).

The cumulative error of +76 is then diffused to neighboring pixels (C, G, H & I) based on the Floyd-Steinberg algorithm. The result is shown in the Waveform Map, after Pixel B is processed.

It is noted that the error value diffused from pixel B must be mathematically added to the existing cumulative error value from processing of previous pixels. For example, pixel G already has an existing cumulative error value of +8 and now an error value of +14 (+76×3/16) is diffused to this pixel, resulting in a cumulative error value of +22 in the Waveform Map, after Pixel B is processed.

For pixel C, its target grey level is 4. If the WG waveform is chosen, it would have a shift error of +79 ((197−118) and if the KG waveform is chosen, it would then have a shift error of −95 (25−120). The sums of "the shift error value and the existing cumulative error", in this case, would be +112 (79+33) and −62 (−95+33) for the WG and KG waveforms respectively. Since the sum from the KG waveform has a smaller absolute value (62 vs. 112), it is selected for pixel C.

The cumulative error of −62 is then diffused to the neighboring pixels (D, H, I & J) based on the Floyd-Steinberg algorithm. The result is shown in the Waveform Map, after Pixel C is processed.

This process continues (from left to right and top to bottom) until the waveform map is complete to show which pixel is driven by which waveform.

Final Waveform Map:

| | | | | | |
|---|---|---|---|---|---|
| A(WG) | B(WG) | C(KG) | D(G) | E(WG) | F(KG) |
| G(KG) | H(WG) | I(WG) | J(KG) | K(WG) | L(WG) |

This alternative method is useful because it may further reduce the local errors by selecting a waveform which would generate a smaller absolute error value.

It is noted that while the Floyd-Steinberg algorithm is used in this example, other error diffusion algorithms may also be similarly applied.

Example 6

Block Diagram of Hardware for Example 5

A block diagram in FIG. 8 illustrates the method demonstrated in Example 5. As shown, the sum of the cumulative error for a pixel in the waveform map (80) and the shift error shift values for both waveforms (the first waveform 81*a* and the second waveform 81*b*) from the grey level variation chart (84) based on the desired color (82) would determine which waveform is selected. Both the selected waveform and the desired color (82) of the pixel are input into the look-up table module (83). The data thus generated from the look-up table module are then output to the display panel.

In the meantime, the sum of the shift error value from a grey level variation chart (84) based on the selected waveform and the desired color (82), and the cumulative error for the pixel in the waveform map (80) undergoes the process of error diffusion (85). The error value diffused to each of the neighboring pixels is then mathematically added to the cumulative error value for that neighboring pixel, resulting in an updated waveform map. The process as described continues.

Example 7

Another Example of Mono-Polar Waveforms

Figure 5:
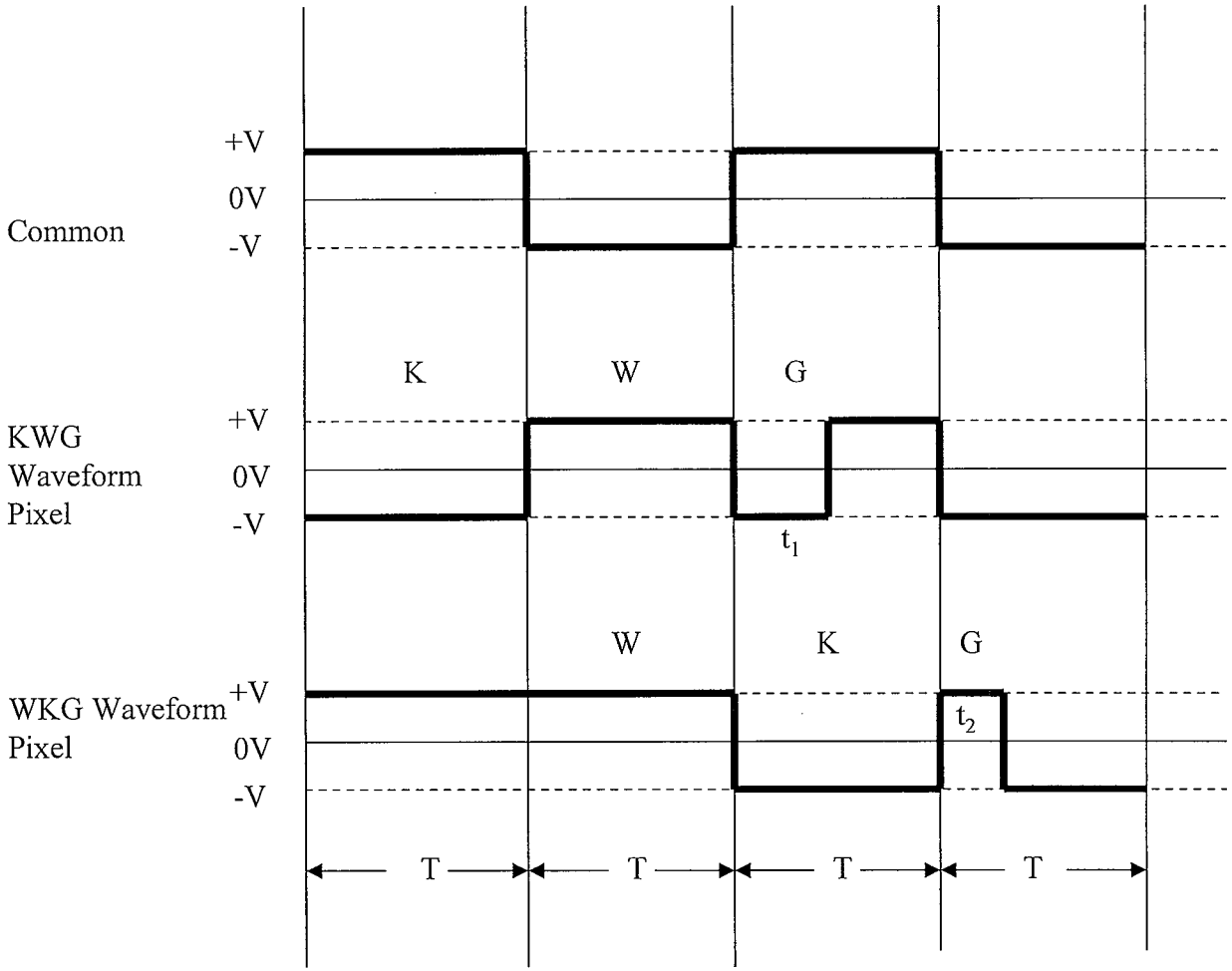
FIG. 5 shows another example of mono-polar waveforms.

FIG. 5 shows alternative mono-polar driving waveforms which would be suitable for the present invention. As shown, there are two driving waveforms, WKG and KWG. When applying the two waveforms, the WKG waveform drive pixels in the first group to the full white state, then to the full black state and finally to a desired color state. The KWG waveform, on the other hand, drives pixels in the second group to the full black state, then to the full white state and finally to a desired color state.

The WKG waveform has a tendency to cause the grey levels to shift towards the darker color, due to speed decay caused by the medium degradation. The KWG waveform has a tendency to cause the grey levels to shift towards the lighter color, due to speed decay.

When utilizing this set of waveforms, one of the driving methods of the present invention may be summarized as follows:

a) selecting the WKG or KWG waveform to drive a pixel to a desired color, based on a cumulative error value resulted from processing of previous pixels, wherein the WKG waveform tends to shift the grey level color states between the black and white colors states towards the black color after degradation, and the KWG waveform tends to shift the grey level color states between the black and white color states towards the white color after degradation;

b) determining a shift error value from a grey level variation chart based on the waveform selected in (a) above and the desired color of the pixel;

c) adding the shift error value to the cumulative error value of the pixel; and d) performing error diffusion.

The alternative driving method may be summarized as a) determining shift error values for both the WKG and KWG waveforms from a grey level variation chart based on the desired color of a pixel, wherein the WKG waveform tends to shift the grey level color states between the black and white colors states towards the black color after degradation, and the KWG waveform tends to shift the grey level color states between the black and white color states towards the white color after degradation;

b) adding each of the shift error values to the cumulative error value of the pixel;

c) selecting the WKG or KWG waveform whose sum of the shift error value and the cumulative error value has a smaller absolute value;

d) determining a shift error value from a grey level variation chart based on the waveform selected in (c) above and the desired color of the pixel;

e) adding the shift error value to the cumulative error value of the pixel; and f) performing error diffusion.

Example 8

Bi-Polar Waveforms

For bi-polar applications, it is possible to update areas from a first color to a second color and also areas from the second color to the first color, at the same time. The bi-polar approach requires no modulation of the common electrode and the driving from one image to another image may be accomplished, as stated, in the same driving phase. For bi-polar driving, no waveform is applied to the common electrode.

The two bi-polar waveforms WG and KG are shown in FIG. 6*a* and FIG. 6*b*, respectively. The bi-polar driving method has only two phases. In addition, as the common electrode in a bi-polar driving method is maintained at ground, the WG and KG waveforms can run independently without being restricted to the shared common electrode.

The methods of the present invention can be applied to the timing controller (T-con) to process the waveform map in real time. Therefore, the actual users do not have to perform any tasks to achieve the desired results.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, materials, compositions, processes, process step or steps, to the objective, spirit and scope of the present invention. All such modifications are intended to be within the scope of the claims appended hereto.

What is claimed is:

1. A driving method for an electrophoretic display, which comprises:

a) selecting a first waveform or a second waveform to drive a pixel to a desired color, wherein said first waveform shifts intermediate color states between a first color state and a second color state towards the first color state after degradation, and said second waveform shifts the intermediate color states between the first color state and the second color state towards the second color state after degradation;

b) determining a shift error value from a grey level variation chart based on the selected first or second waveform in (a) above and the desired color of the pixel;

c) adding the shift error value to a cumulative error value of said pixel; and d) performing error diffusion based on the cumulative error value and the grey level variation chart.

2. The method of claim 1, wherein said step (a) is carried out based on the cumulative error value of the pixel.

3. The method of claim 2, wherein the first waveform is selected if the cumulative error value indicates the shift to the second color state after degradation or the second waveform is selected if the cumulative error value indicates the shift to the first color state after degradation.

4. The method of claim 1 wherein step (d) comprises:

i) diffusing the sum of the shift error value and the cumulative error value of the pixel, to the neighboring pixels; and ii) adding the error value diffused to the cumulative error value resulted from processing of previous pixels, for each neighboring pixel.

5. The method of claim 1, wherein said cumulative error values for each pixel are generated in a waveform map.

6. The method of claim 1, wherein step (a) is carried out by:

i) determining shift error values for both the first waveform and the second waveform from the grey level variation chart based on the desired color of a pixel, wherein said first waveform shifts the intermediate color states between the first color state and the second color state towards the first color state after degradation, and said second waveform shifts the intermediate color states between the first color state and the second color state towards the second color state after degradation;

ii) adding each of the shift error values to the cumulative error value of the pixel; and iii) selecting the first waveform or the second waveform whose sum of the shift error value and the cumulative error value has a smaller absolute value.

7. The method of claim 6, wherein said step (d) comprises:

i) diffusing the sum of the shift error value and the cumulative error value of said pixel, to neighboring pixels; and ii) adding the error diffused to the cumulative error value resulted from processing of previous pixels, for each neighboring pixel.

8. The method of claim 6, wherein the cumulative error values for each pixel are generated in a waveform map.

9. The method of claim 1, wherein said first waveform and said second waveform are white to grey and black to grey waveforms, respectively.

10. The method of claim 1, wherein said first waveform and said second waveform are white to black to grey and black to white to grey waveforms, respectively.

11. The method of claim 1, wherein said first waveform and said second waveform are mono-polar waveforms.

12. The method of claim 1, wherein said first waveform said the second waveform are bi-polar waveforms.

* * * * *